US008191385B2

(12) United States Patent
Wei et al.

(10) Patent No.: US 8,191,385 B2
(45) Date of Patent: Jun. 5, 2012

(54) TWO-STAGE EXPANSION COOLING SYSTEM AND EVAPORATOR THEREOF

(75) Inventors: Chung-Szu Wei, Hsinchu County (TW); Jane-Sunn Liaw, Taichung (TW); Chi-Chuan Wang, Hsinchu County (TW); Kai-Shing Yang, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 733 days.

(21) Appl. No.: 12/342,117

(22) Filed: Dec. 23, 2008

(65) Prior Publication Data

US 2010/0071405 A1 Mar. 25, 2010

(30) Foreign Application Priority Data

Sep. 22, 2008 (TW) ..... 97136375 A

(51) Int. Cl.
*F25B 39/02* (2006.01)

(52) U.S. Cl. ..... 62/525; 62/524

(58) Field of Classification Search ..... 62/516, 62/519, 524, 527, 515, 259.1, 259.2, 525, 62/526

See application file for complete search history.

(56) References Cited

U.S. PATENT DOCUMENTS

| | | | | |
|---|---|---|---|---|
| 265,430 | A | 10/1882 | Park, Jr. | |
| 6,166,907 | A * | 12/2000 | Chien | 361/699 |
| 6,993,919 | B2 * | 2/2006 | Hirooka et al. | 62/115 |
| 7,181,921 | B2 * | 2/2007 | Nuiding | 62/198 |
| 7,308,802 | B2 * | 12/2007 | Liu et al. | 62/259.2 |
| 7,987,681 | B2 * | 8/2011 | Cochran | 62/222 |
| 2006/0196207 | A1 * | 9/2006 | Lee et al. | 62/259.1 |
| 2006/0225460 | A1 * | 10/2006 | Marques | 62/515 |
| 2008/0178608 | A1 * | 7/2008 | Tandou et al. | 62/6 |
| 2008/0196867 | A1 * | 8/2008 | Spearing | 165/104.33 |

FOREIGN PATENT DOCUMENTS

| | | | |
|---|---|---|---|
| CN | 1623070 | A | 6/2005 |
| CN | 2864526 | Y | 1/2007 |
| CN | 1308632 | C | 4/2007 |
| TW | M291508 | | 6/2006 |
| WO | WO 03/062719 | * | 7/2003 |

OTHER PUBLICATIONS

Machine Translation of Description of WO 03062719, Translated on Sep. 1, 2009, obtained from translationportal.epo.org.*
Foreign Office Action for Application No. 200810171118.5 dated Apr. 13, 2011; SIPO.

* cited by examiner

*Primary Examiner* — Cheryl J Tyler
*Assistant Examiner* — Orlando E Aviles Bosques
(74) *Attorney, Agent, or Firm* — Stevens & Showalter LLP

(57) ABSTRACT

An evaporator, applicable to a two-stage expansion cooling system, is used for receiving a high-pressure liquid working fluid. The evaporator includes a thermal-conductive block having a channel system. The channel system includes a high-pressure channel, a low-pressure channel, and a second stage expansion channel. The second stage expansion channel has an input end and an output end. The input end is communicated with the high-pressure channel. The output end is communicated with the low-pressure channel, and has a cross-sectional area smaller than that of the low-pressure channel. The high-pressure liquid working fluid flows into the thermal-conductive block from the high-pressure channel, and then enters the second stage expansion channel through the input end. A part of the high-pressure liquid working fluid flowing out of the output end expands into a saturated low-pressure liquid working fluid and enters the low-pressure channel.

20 Claims, 3 Drawing Sheets

TWO-STAGE EXPANSION COOLING SYSTEM AND EVAPORATOR THEREOF

CROSS-REFERENCE TO RELATED APPLICATIONS

This non-provisional application claims priority under 35 U.S.C. §119(a) on Patent Application No(s). 097136375 filed in Taiwan, R.O.C. on Sep. 22, 2008 the entire contents of which are hereby incorporated by reference.

BACKGROUND OF THE INVENTION

1. Field of the Invention

The present invention relates to a cooling system and an evaporator thereof, and more particularly to a two-stage expansion cooling system and an evaporator thereof.

2. Related Art

Currently, an electronic device in the market is generally formed by various electronic components. As the performance of the computer has been increasingly enhanced, more and more heats are generated by the electronic components. Among these components, the central processing unit (CPU) operates even faster, and thus becomes the electronic component that generates the most heats per unit time within the electronic device. On the other aspect, besides the increased heat generated by the electronic components, as the size of the electronic device is gradually reduced, the heat dissipation effect of the electronic device is deteriorated due to the allocation of these components within an increasingly reduced space. Based upon such a developing trend of the electronic device, after working for a long time, the temperature of the working environment in the electronic device is greatly raised due to the heat generated by the CPU. As a result, the excessively high-temperature working environment may affect the normal operation of the electronic device, and thus the failure and damage rates of the electronic device will be increased. Therefore, it is a tough problem to be solved by manufacturers about how to rapidly and effectively dissipate the heat from the CPU.

In the prior art, in order to solve the heat dissipation problem of the CPU, a heat dissipation module is mounted on the CPU to dissipate the heat generated thereby, so as to prevent the CPU getting overheated. The conventional heat dissipation module has a base attached to a surface of the CPU and a plurality of heatsink fins connected to the base. The heat generated by the CPU is conducted from the CPU to the base, and then from the base to the heatsink fins. As the heatsink fins contact the outside air at a large contact area, the heat is rapidly dissipated to the ambient environment. When the heat dissipation module cannot satisfy the heat dissipation requirement, a fan is further added to the heat dissipation module in the prior art to enhance the heat dissipation effect. However, as the CPU generates more and more heat, the technology of dissipating heat through the base and a fan has gradually come to a bottleneck.

Accordingly, a water-cooling system is provided in the prior art. The water-cooling system includes an evaporator, a condenser, a conduct pipe, and a pump. The cooling water is circulated in the water-cooling system. The evaporator thermally contacts the CPU. The evaporator, the heat sink, and the pump are communicated with each other via the conduct pipe. The cooling water is driven by the pump to circulate among the evaporator, the heat sink, and the pump via the conduct pipe. The condenser is used to remove the heat from the cooling water. Based on the above system, the heat generated by the CPU is absorbed by the cooling water in the evaporator when passing through the evaporator. After the above heat absorption process, the cooling water is driven by the pump to enter the condenser via the conduct pipe, and the heat absorbed by the cooling water is then released through the condenser. Then, after the heat dissipation process, the cooling water is again driven by the pump to enter the evaporator, thereby completing a cooling circulation.

However, as for the water-cooling system in the prior art, when the cooling water flows through the evaporator, the temperature of the cooling water rises due to the absorption of the heat generated by the CPU. However, during the whole heat absorption process, the cooling water remains in a liquid state. Therefore, if the heat generated by the CPU is increased abruptly, and as the size of the electronic device has been continuously reduced, the heat dissipation performance of the water-cooling system has gradually come to a bottleneck.

Typical implementations of the low temperature designs are thermoelectrics and refrigeration. Among them, refrigeration is capable of operating in high-temperature ambient, yet it is also quite reliable and cost-effective. Moreover, its COP (coefficient of performance) is well above the present thermoelectrics system. There are also other advantages for exploiting the refrigeration cooling, such as maintenance of low junction temperatures while dissipating high heat fluxes, potential increases in microprocessor performance at lower operating temperatures, and increased chip reliability. However, there are several major concerns in the application of refrigeration systems to cool electronics include condensation of the evaporator cold plate where the electronics components are mounted. The first one is associated with the condensation on the surfaces when the temperature is below the dew point temperature of the surrounding air and the second concern is the systems lagging response to applied load at the evaporator. The presence of water condensate can bring hazards to the electronic system and must be avoided all the time. Typical solutions to the first concern may involve clumsy insulation or using heater to vaporize condensate outside the cold plate. The former requires considerable space that is often quite limited in practice and is apt to reduce the overall system performance due to blockage of the air flow. The later design not only raises problem in control but is also sceptical to additional energy consumption. In summary of these two designs, one can see there is a need for novel design to employ the refrigeration cooling in electronic cooling. It is therefore the objective of this invention. We have proposed a novel design that can completely eliminate the concern in condensate formation.

SUMMARY OF THE INVENTION

Accordingly, the present invention is directed to a two-stage expansion cooling system and an evaporator thereof, applicable to rapidly remove the heat from a heat source, so as to solve the problem in the prior art that the heat dissipation performance is rather poor and the refrigeration system in condensate formation.

In order to achieve the aforementioned or other objectives, the present invention provides an evaporator applicable to a two-stage expansion cooling system, which is used for receiving a high-pressure liquid working fluid. The evaporator includes a thermal-conductive block having a channel system therein. The channel system includes a high-pressure channel, a low-pressure channel, and a second stage expansion channel. The second stage expansion channel has an input end and an output end. The input end is communicated with the high-pressure channel. The output end is communicated with the low-pressure channel and has a cross-sectional area smaller than that of the low-pressure channel. The high-pressure liquid working fluid enters the thermal-conductive block through the high-pressure channel, and then flows into the second stage expansion channel through the input end. When flowing out of the output end and entering the low-pressure channel, a part of the high-pressure liquid working fluid expands into a saturated low-pressure liquid working fluid.

In order to achieve the aforementioned or other objectives, the present invention provides a two-stage expansion cooling system, which is adapted to remove the heat from a heat generating object by a working fluid circulated therein. The two-stage expansion cooling system includes a compressor, a condenser, a first-stage expansion device, and an evaporator. The compressor compresses the working fluid to form a high-pressure liquid working fluid. Next, the high-pressure liquid working fluid is transferred to the condenser for reducing a temperature of the high-pressure liquid working fluid. Then, the cooled high-pressure liquid working fluid is transferred to the first-stage expansion device for reducing pressure and temperature. Then, the working fluid is transferred to the evaporator. The temperature of the refrigerant from the first-stage expansion device is designated to be above the corresponding dew point temperature of the ambient. As a consequence, there will be no humidification problem outside the surface of the cold-plate since the temperature is above dew point. The evaporator includes a thermal-conductive block, and the thermal-conductive block has a channel system therein. The channel system includes a high-pressure channel, a low-pressure channel, and a second stage expansion channel. The second stage expansion channel has an input end and an output end. The input end is communicated with the high-pressure channel. The output end is communicated with the low-pressure channel and has a cross-sectional area smaller than that of the low-pressure channel. The cooled high-pressure liquid working fluid flows into the thermal-conductive block from the high-pressure channel, and enters the second stage expansion channel through the input end. As the working fluid flow through the second stage expansion device in cold plate, its temperature is further reduced below the dew point temperature, leading to a much larger temperature difference between heat source and the refrigerant whereas the temperature of the refrigerant at the high-pressure channel is still above the dew point temperature. The low-pressure liquid working fluid in the low-pressure channel absorbs the heat from the heat generating object through the thermal-conductive block, and then returns to the compressor after the heat absorption process, thereby completing a circulation.

According to a preferred embodiment of the present invention, a cross-sectional area of the input end is equal to that of the output end. Preferably, a cross-sectional area of the high-pressure channel is larger than that of the input end. Furthermore, any two sections of the second stage expansion channel have the same cross-sectional area.

According to a preferred embodiment of the present invention, the cross-sectional area of the input end is larger than that of the output end. Preferably, the cross-sectional area of the input end is equal to that of the high-pressure channel. Furthermore, the second stage expansion channel is tapered from the input end to the output end.

According to a preferred embodiment of the present invention, the thermal-conductive block includes an upper assembly and a lower assembly. The lower assembly has a joint surface. The lower assembly is joined to the upper assembly through the joint surface. The joint surface has a concave pattern. The lower assembly together with the upper assembly defines the high-pressure channel, the low-pressure channel, and the second stage expansion channel through the concave pattern. Preferably, the high-pressure channel extends along a peripheral edge of the joint surface, and surrounds an outer periphery of the low-pressure channel and the second stage expansion channel. Furthermore, in this embodiment, the evaporator further includes an O-ring disposed between the upper assembly and the lower assembly.

As described above, in the present invention, the heat generated by the heat source is absorbed through the phase change of the working fluid in the low-pressure channel. Therefore, compared with the prior art, the present invention achieves a better heat dissipation performance and eliminate the concern in condensate formation. In addition, in the present invention, the high-pressure channel extends along the peripheral edge of the joint surface, and surrounds the outer periphery of the low-pressure channel and the second stage expansion channel, such that moistures are prevented from being condensed on the outer surface of the evaporator.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

The detailed features and advantages of the present invention will be described in detail in the following embodiments. Those skilled in the arts can easily understand and implement the content of the present invention. Furthermore, the relevant objectives and advantages of the present invention are apparent to those skilled in the arts with reference to the content disclosed in the specification, claims, and drawings. The following embodiments are merely intended to illustrate the technical solutions of the present invention, but not limited the scope of the present invention.

Figure 1:
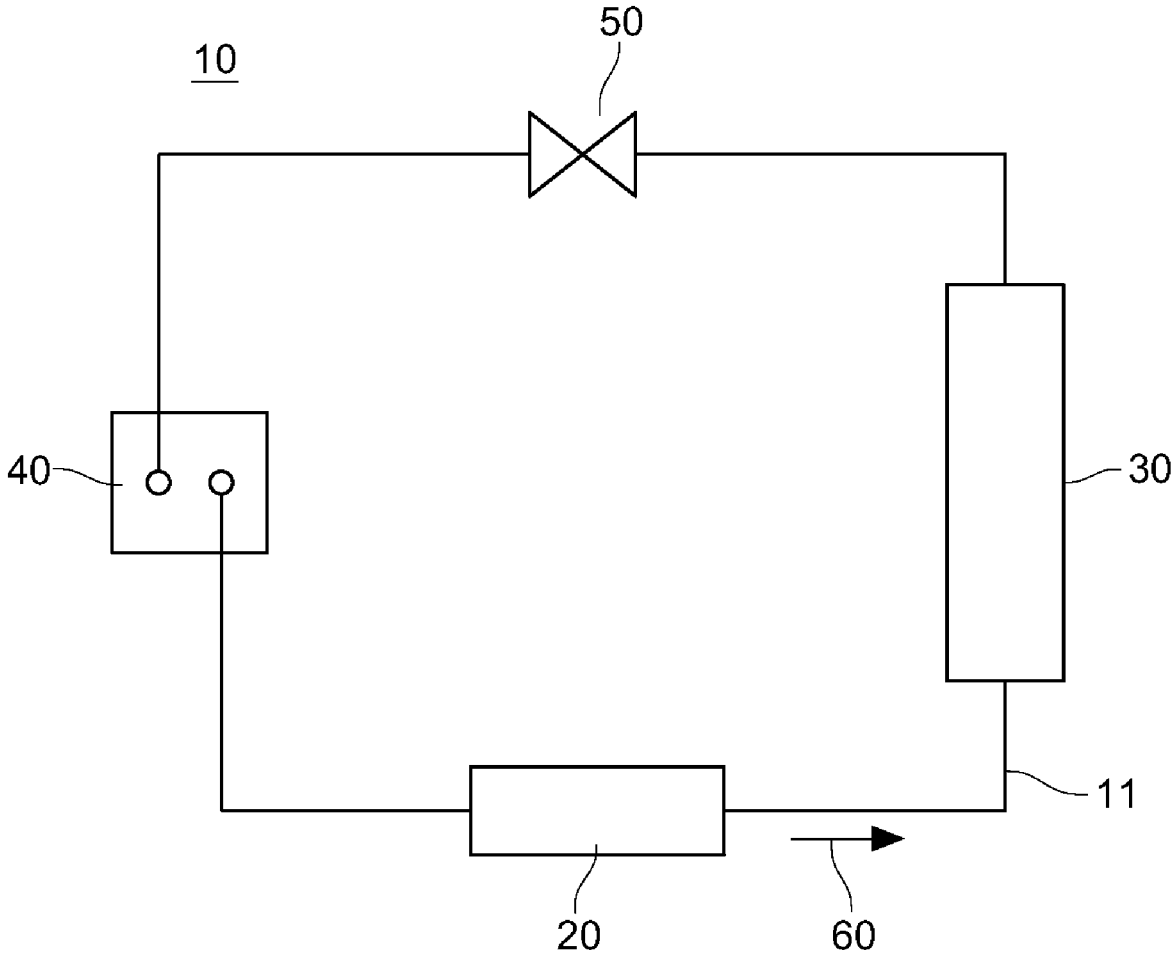
FIG. 1 is a schematic view of a two-stage expansion cooling system according to an embodiment of the present invention.

FIG. 1 is a schematic view of a two-stage expansion cooling system according to an embodiment of the present invention. Referring to FIG. 1, a two-stage expansion cooling system 10 includes a compressor 20, a condenser 30, an evaporator 40, and a first-stage expansion device 50. The compressor 20, the condenser 30, first-stage expansion device 50, and the evaporator 40 are communicated with each other via a conduct pipe 11. In particular, the compressor 20 is communicated with the condenser 30 via the conduct pipe 11, the condenser 30 is communicated with the first-stage expansion device 50 via the conduct pipe 11, the first-stage expansion device 50 is communicated with the evaporator 40 via the conduct pipe 11, and the evaporator 40 is communicated with the compressor 20 via the conduct pipe 11. A working fluid 60 is loaded within the two-stage expansion cooling system 10, and circulated among the compressor 20, the condenser 30, first-stage expansion device 50, and the evaporator 40 via the conduct pipe 11. The material of the working fluid 60 may be R-134*a*, R-12, R-22, or other types of refrigerants.

The operation of the two-stage expansion cooling system 10 is described as follows.

First, a gaseous working fluid 60 is compressed by the compressor 20 into a high-pressure gaseous working fluid 60. Next, the high-pressure gaseous working fluid 60 flows into the condenser 30 via the conduct pipe 11. The high-pressure gaseous working fluid 60 in the condenser 30 releases its heat to the ambient environment, and is transited into a high-pressure liquid working fluid 60. In this embodiment, the heat of the high-pressure gaseous working fluid 60 is dissipated to the ambient environment by a fan (not shown). It should be noted that, the manner for dissipating the heat of the high-pressure gaseous working fluid 60 is not limited in this embodiment. Those skilled in the art may come up with other heat dissipation manners based on the above descriptions, and the details are not given here again.

Then, after passing through the condenser 30, the high-pressure liquid working fluid 60 enters the first-stage expansion device 50 for reducing pressure and temperature. The liquid working fluid 60 enters the evaporator 40 via the conduct pipe 11. Then, the working fluid 60 through the second stage expansion device in the evaporator 40, its temperature is further reduced below the dew point temperature, leading to a much larger temperature difference between heat source and the refrigerant whereas the temperature of the refrigerant at the high-pressure channel is still above the dew point temperature. In this embodiment, the evaporator 40 thermally contacts a heat source, such that the low-pressure liquid working fluid 60 absorbs the heat of the heat source through the evaporator 40, so as to generate a low-pressure gaseous working fluid 60. Afterwards, the low-pressure gaseous working fluid 60 returns to the compressor 20 via the conduct pipe 11 and is recompressed into the high-pressure gaseous working fluid 60.

The above evaporator 40 is described as follows.

Figure 2:
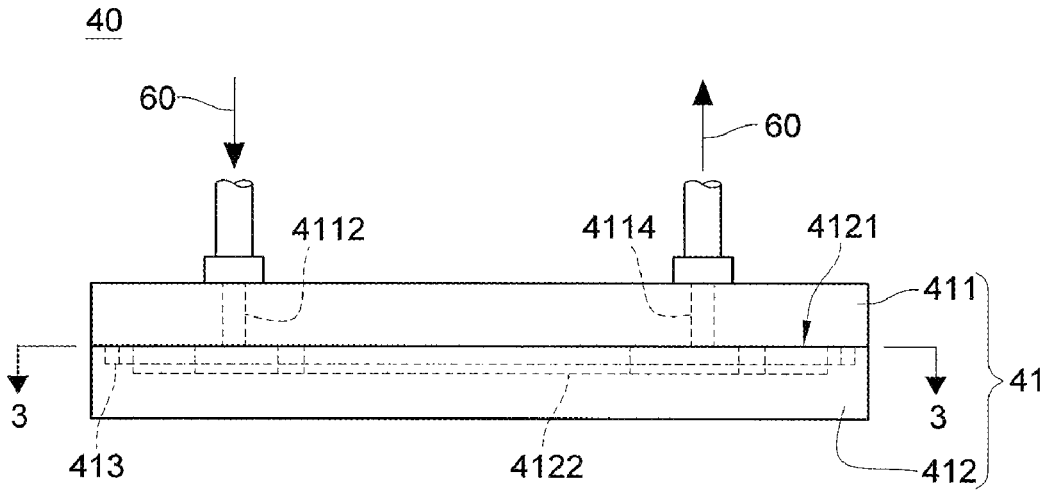
FIG. 2 is a schematic side view of an evaporator in FIG. 1.
Figure 3:
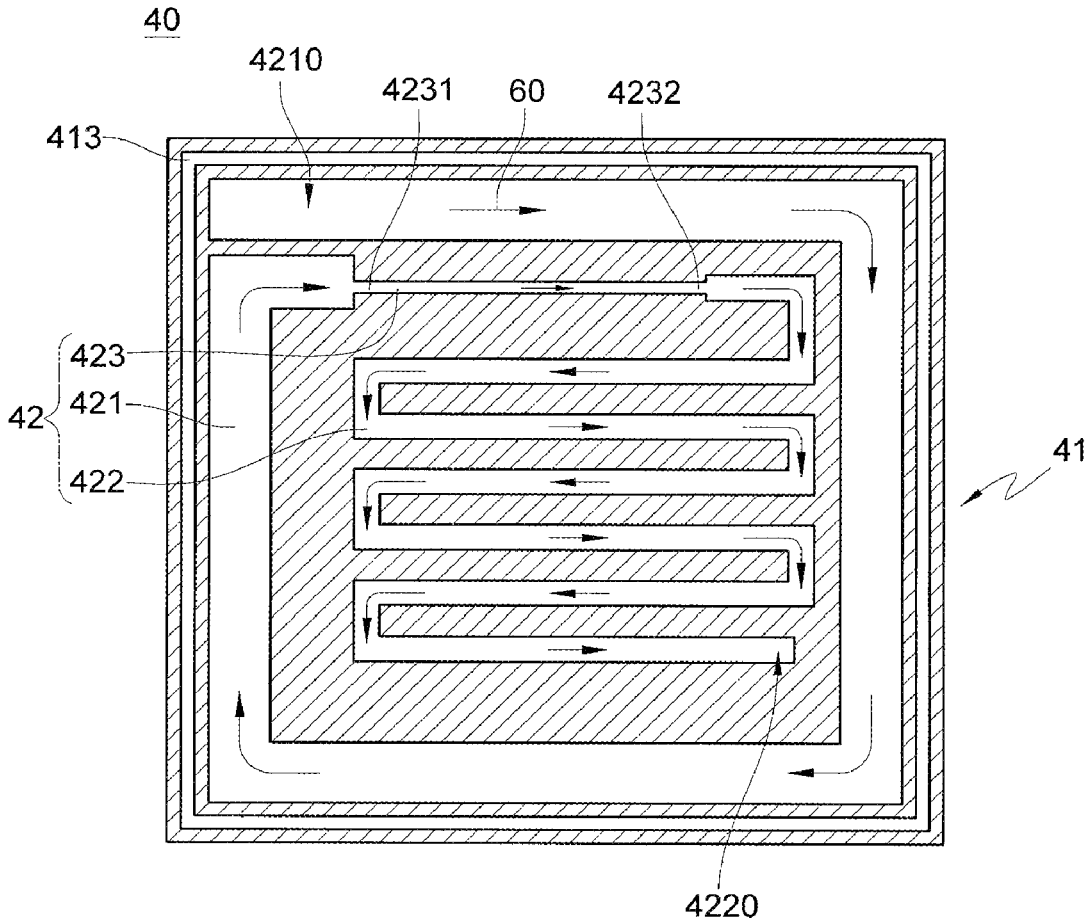
FIG. 3 is a schematic cross-sectional view of the evaporator in FIG. 2, taken along a section line 3-3.

FIG. 2 is a schematic side view of the evaporator in FIG. 1. FIG. 3 is a schematic cross-sectional view of the evaporator in FIG. 2, taken along a section line 3-3. Referring to both FIGS. 2 and 3, the evaporator 40 includes a thermal-conductive block 41 made of copper, aluminum, or other materials with desirable thermal conductivity. The thermal-conductive block 41 includes an upper assembly 411 and a lower assembly 412. The upper assembly 411 has an input through-hole 4112 and an output through-hole 4114. The lower assembly 412 has a joint surface 4121 with a concave pattern 4122. When the upper assembly 411 is joined to the lower assembly 412, the lower assembly 412 together with the upper assembly 411 defines a channel system 42 through the concave pattern 4122. It should be noted that, though the concave pattern 4122 is formed on the lower assembly 412 in this embodiment, the manner for forming the channel system 42 in the thermal-conductive block 41 is not limited herein. Those skilled in the art may come up with other manners for forming the channel system 42 based on this embodiment. For example, those skilled in the art may form the concave pattern 4122 on the upper assembly 411, such that the upper assembly 411 and the lower assembly 412 together form the channel system 42. Furthermore, in this embodiment, in order to enable the upper assembly 411 and the lower assembly 412 to be joined together more tightly, an O-ring 413 is disposed between the upper assembly 411 and the lower assembly 412. Therefore, when the upper assembly 411 is joined to the lower assembly 412, the upper assembly 411 presses the O-ring 413 against the lower assembly 412, and thus the O-ring 413 is deformed to enhance the sealing property between the upper assembly 411 and the lower assembly 412.

The channel system 42 includes a high-pressure channel 421, a low-pressure channel 422, and a second stage expansion channel 423. The high-pressure channel 421 is communicated with the input through-hole 4112. The second stage expansion channel 423 has a fixed cross-sectional area, i.e., any two sections of the second stage expansion channel have the same cross-sectional area. The second stage expansion channel 423 has an input end 4231 and an output end 4232. The input end 4231 is communicated with the high-pressure channel 421, and the output end 4232 is communicated with the low-pressure channel 422. A cross-sectional area of the input end 4231 is smaller than that of the high-pressure channel. A cross-sectional area of the output end 4232 is smaller than that of the low-pressure channel 422. A distal end 4220 of the low-pressure channel 422 is communicated with the output through-hole 4114.

Based on the above structure, the high-pressure liquid working fluid 60 from the condenser 30 enters an upper end 4210 of the high-pressure channel 421 in the lower assembly 412 through the input through-hole 4112 of the upper assembly 411. Next, the high-pressure liquid working fluid 60 enters the second stage expansion channel 423 through the input end 4231. Then, the high-pressure liquid working fluid 60 enters the low-pressure channel 422 through the output end 4232. It should be noted that, when the high-pressure liquid working fluid 60 enters the low-pressure channel 422 through the output end 4232, as the cross-sectional area of the output end 4232 is smaller than that of the low-pressure channel 422, at least a part of the high-pressure liquid working fluid 60 expands into the saturated low-pressure liquid working fluid 60 due to the sudden enlargement of the cross-sectional area. In addition, the temperature of the low-pressure liquid working fluid 60 is lower than that of the high-pressure liquid working fluid 60.

Furthermore, as known from the above, the thermal-conductive block 41 has a desirable thermal conductivity, and the temperature of the low-pressure liquid working fluid 60 formed by the high-pressure liquid working fluid 60 through the expansion process is usually lower than a dew point temperature in the ambient environment. Therefore, during the heat absorption process of the low-pressure liquid working fluid 60, the above configuration may cause that the temperature on the surface of the thermal-conductive block 41 is lower than the dew point temperature in the ambient environment. When moistures from the ambient environment are condensed on the surface of the thermal-conductive block 41, water drops are formed and may fall off under the effect of gravity. In this embodiment, when the heat source in contact with the evaporator 40 is an electronic component, the dripping water drops may cause short circuit of the electronic component.

In order to solve the above problem, in this embodiment, the high-pressure channel 421 extends along a peripheral edge of the joint surface 4121, and surrounds an outer periphery of the low-pressure channel 422 and the second stage expansion channel 423. That is, the high-pressure channel 421 surrounds and encloses the low-pressure channel 422 and the second stage expansion channel 423. In this embodiment, the output power of the compressor 20 and the heat dissipation rate of the condenser 30 can be properly adjusted, so as to enable the temperature of the high-pressure liquid working fluid 60 be higher than the dew point temperature in the ambient environment. Therefore, in this embodiment, the temperature on the surface of the thermal-conductive block 41 remains above the dew point temperature in the ambient environment through the high-pressure liquid working fluid 60. As such, the problem about moisture condensation on the surface of the thermal-conductive block 41 is solved.

Figure 4:
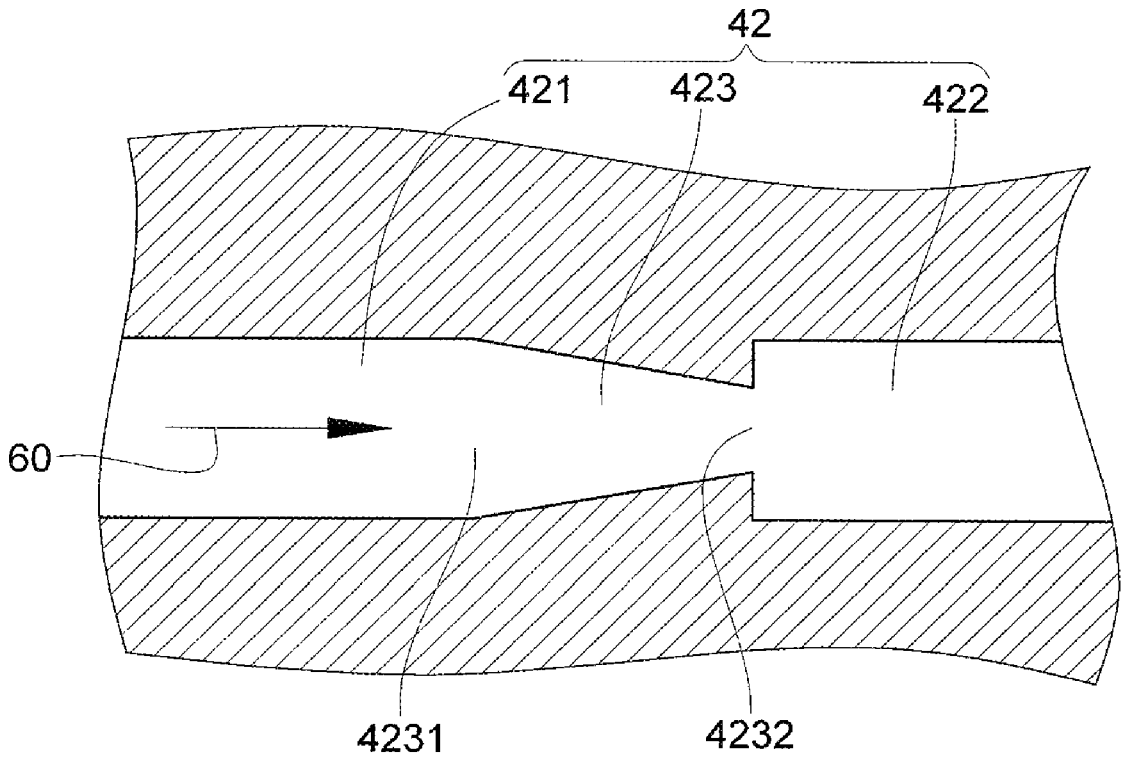
FIG. 4 is a schematic cross-sectional view of a channel system according to another embodiment of the present invention.

In the above embodiment, the second stage expansion channel 423 has a fixed cross-sectional area. However, in another embodiment of the present invention, the cross-sectional area of the second stage expansion channel 423 may be tapered from the input end 4231 to the output end 4232. FIG. 4 is a schematic cross-sectional view of a channel system according to another embodiment of the present invention. Referring to FIG. 4, the cross-sectional area of the second stage expansion channel 423 is tapered from the input end 4231 to the output end 4232. The cross-sectional area of the input end 4231 is larger than that of the output end 4232. The proportion between the cross-sectional area of the input end 4231 and that of the output end 4232 may be adjusted depending upon the heat dissipation requirements of the system. Compared with the second stage expansion channel 423 with a fixed cross-sectional area shown in FIG. 3, the above tapered configuration enables the high-pressure liquid working fluid 60 to achieve the same expansion effect with a much shorter second stage expansion channel 423 shown in FIG. 4.

In view of the above, in the present invention, the heat generated by the heat source is absorbed through the phase change of the working fluid in the low-pressure channel. Therefore, compared with the prior art, the present invention achieves a better heat dissipation performance and eliminate the concern in condensate formation. In addition, in the present invention, as the high-pressure channel extends along the peripheral edge of the joint surface, and surrounds the outer periphery of the low-pressure channel and the second stage expansion channel, moistures are prevented from being condensed on the outer surface of the evaporator, thereby avoiding the short circuit of the electronic component caused by the dripping of the condensed moisture drops.

What is claimed is:

1. An evaporator, adapted to a two-stage expansion cooling system, for receiving a high-pressure liquid working fluid, the evaporator comprising:

a thermal-conductive block having a channel system therein and receiving a liquid that has been expanded in a first stage expansion device, wherein the channel system comprises:

a high-pressure channel provided for the high-pressure liquid working fluid to enter the thermal-conductive block through the high-pressure channel;

a low-pressure channel having a cross-sectional area smaller than that of the high-pressure channel; and a second stage expansion channel having:

an input end and an output end;

a length defined by the distance from the input end to the output end; and a first side and a second side opposite the first side when an axis exists throughout the length of the second stage expansion channel;

wherein the input end is communicated with the high-pressure channel, the output end is communicated with the low-pressure channel and has a cross-sectional area smaller than that of the low-pressure channel, the second stage expansion channel is between the high-pressure channel and the low-pressure channel, the high-pressure liquid working fluid enters the second stage expansion channel through the input end, and a part of the high-pressure liquid working fluid flowing out of the output end expands into a saturated low-pressure liquid working fluid and enters the low-pressure channel, and wherein the high pressure channel extends around the low pressure channel on four sides, a section of the high pressure channel extends in parallel to the entire length of the second stage expansion channel at the first side, and a section of the low pressure channel extends in parallel to the entire length of the second stage expansion channel at the second side.

2. The evaporator according to claim 1, wherein a cross-sectional area of the input end is equal to that of the output end.

3. The evaporator according to claim 2, wherein a cross-sectional area of the high-pressure channel is larger than that of the input end.

4. The evaporator according to claim 2, wherein any two sections of the second stage expansion channel have the same cross-sectional area.

5. The evaporator according to claim 1, wherein the cross-sectional area of the input end is larger than that of the output end.

6. The evaporator according to claim 5, wherein the cross-sectional area of the input end is equal to that of the high-pressure channel.

7. The evaporator according to claim 5, wherein the second stage expansion channel is tapered from the input end to the output end.

8. The evaporator according to claim 1, wherein the high-pressure channel extends along a peripheral edge of the joint surface, and surrounds an outer periphery of the low-pressure channel and the second stage expansion channel.

9. The evaporator according to claim 1, further comprising an O-ring, disposed between the upper assembly and the lower assembly.

10. The evaporator according to claim 1, wherein the thermal block further comprises an upper assembly and a lower assembly joined to the upper assembly through a joint surface, the joint surface having a concave pattern to form the high-pressure channel, the low-pressure channel, and the second stage expansion channel.

11. A two-stage expansion cooling system, adapted to remove heat from a heat generating object by a working fluid circulated therein, the system comprising:

a compressor, for compressing the working fluid to form a high-pressure liquid working fluid;

a condenser, for reducing a temperature of the high-pressure liquid working fluid;

a first stage expansion device, for reducing the pressure and the temperature of the high-pressure liquid working fluid, wherein the temperature of the high-pressure liquid working fluid is above a dew point temperature of the ambient; and an evaporator, for receiving the cooled high-pressure liquid working fluid, wherein the evaporator further comprises:

a thermal-conductive block having a channel system therein and receiving a liquid that has been expanded in a first stage expansion device, wherein the channel system further comprises:

a high-pressure channel provided for the high-pressure liquid working fluid to enter the thermal-conductive block through the high-pressure channel;

a low-pressure channel communicated with the compressor and having a cross-sectional area smaller than that of the high-pressure channel; and a second stage expansion channel having:

an input end and an output end;

a length defined by the distance from the input end to the output end; and a first side and a second side opposite the first side when an axis exists throughout the length of the second stage expansion channel;

wherein the input end is communicated with the high-pressure channel, the output end is communicated with the low-pressure channel and has a cross-sectional area smaller than that of the low-pressure channel, the second stage expansion channel is between the high-pressure channel and the low-pressure channel, the high-pressure liquid working fluid enters the second stage expansion channel through the input end, a part of the high-pressure liquid working fluid expands into a saturated low-pressure liquid working fluid of which the temperature is below the dew point at the output end and enters the low-pressure channel, and the low-pressure liquid working fluid in the low-pressure channel absorbs heat from the heat generating object through the thermal-conductive block and then enters the compressor, and wherein the high pressure channel extends around the low pressure channel on four sides, a section of the high pressure channel extends in parallel to the entire length of the second stage expansion channel at the first side, and a section of the low pressure channel extends in parallel to the entire length of the second stage expansion channel at the second side.

12. The two-stage expansion cooling system according to claim 11, wherein a cross-sectional area of the input end is equal to that of the output end.

13. The two-stage expansion cooling system according to claim 12, wherein a cross-sectional area of the high-pressure channel is larger than that of the input end.

14. The two-stage expansion cooling system according to claim 12, wherein any two sections of the second stage expansion channel have the same cross-sectional area.

15. The two-stage expansion cooling system according to claim 11, wherein the cross-sectional area of the input end is larger than that of the output end.

16. The two-stage expansion cooling system according to claim 15, wherein the cross-sectional area of the input end is equal to that of the high-pressure channel.

17. The two-stage expansion cooling system according to claim 15, wherein the second stage expansion channel is tapered from the input end to the output end.

18. The two-stage expansion cooling system according to claim 11, wherein the high-pressure channel extends along a peripheral edge of the joint surface, and surrounds an outer periphery of the low-pressure channel and the second stage expansion channel.

19. The two-stage expansion cooling system according to claim 11, wherein the thermal-conductive block further comprises an O-ring, disposed between the upper assembly and the lower assembly.

20. The two-stage expansion cooling system according to claim 11, wherein the thermal block further comprises an upper assembly and a lower assembly joined to the upper assembly through a joint surface, the joint surface having a concave pattern to form the high-pressure channel, the low-pressure channel, and the second stage expansion channel.

* * * * *